US005323683A

United States Patent [19]

Dilhan et al.

[11] Patent Number: 5,323,683

[45] Date of Patent: Jun. 28, 1994

[54] SYSTEMS INCLUDING A DEPLOYABLE ELONGATE PYROTECHNICAL-FUNCTION ELEMENT

[75] Inventors: Denis Dilhan, Auterive; Jean Baricos, Ramonville St Agne, both of France

[73] Assignee: Etienne Lacroix Tous Artifices S.A., Muret, France

[21] Appl. No.: 968,178

[22] Filed: Oct. 29, 1992

[30] Foreign Application Priority Data

.Oct. 31, 1991 [FR] France ..... 91 13492

[51] Int. Cl.[5] ..... F41H 11/14

[52] U.S. Cl. ..... 89/1.13

[58] Field of Search ..... 89/1.13; 102/403

[56] References Cited

U.S. PATENT DOCUMENTS 2,455,354 12/1948 Bisch ..... 89/1.13
3,183,835 5/1965 Bisch ..... 89/1.13
3,242,862 3/1966 Stegbeck et al. ..... 89/1.13
3,638,569 2/1972 Thomanek ..... 89/1.13
4,823,672 4/1989 Eidelman ..... 89/1.13
4,967,636 11/1990 Murray et al. ..... 89/1.13

FOREIGN PATENT DOCUMENTS 0305160 1/1989 European Pat. Off. .
2592947 7/1987 France .

*Primary Examiner*—David H. Brown
*Attorney, Agent, or Firm*—Blakely, Sokoloff, Taylor & Zafman

[57] ABSTRACT

The present invention relates to a pyrotechnical system comprising at least one flexible elongate pyrotechnical-function element and means suitable for deploying said elongate element in a chosen direction, wherein the system further comprises a support structure comprising an inflatable flexible container which receives the elongate element and which is provided with internal spacer fins suitable for supporting the elongate element, for being deployed simultaneously therewith, and for supporting the pyrotechnical-function element above the ground.

13 Claims, 3 Drawing Sheets

SYSTEMS INCLUDING A DEPLOYABLE ELONGATE PYROTECHNICAL-FUNCTION ELEMENT

The present invention relates to systems including a deployable elongate pyrotechnical-function element.

In the context of the present application, the term "pyrotechnical-function" covers both incendiary fire effects and explosion effects.

BACKGROUND OF THE INVENTION

Various systems have already been proposed comprising:

at least one elongate flexible pyrotechnical-function element; and means suitable for deploying said elongate pyrotechnical-function element in a chosen direction.

For example, such means are described in the following documents: FR-A-2 226 064, U.S. Pat. No. 3,610,089, FR-A-2 076 906 FR-A-2 592 947, FR-A-2 214 099, and EP-A-0 305 160.

A first application of such systems is rapid mine clearance over a zone that is long and narrow, so as to create a breach and allow men and/or vehicles to pass through a mine field.

A second application is used for setting fire to installations to which it is difficult to gain final access, i.e. which remain out of range for conventional incendiary devices.

The implementation of such known systems is illustrated diagrammatically in accompanying FIGS. 1A to 1D.

Accompanying FIG. 1A is a diagram showing a container 10 placed on the ground and containing a tube 20 that is coiled down inside the container and that is provided with a thruster 30.

FIG. 1B shows the stage during which the tube 20 is propelled by means of the thruster 30.

Accompanying FIG. 1C shows the tube 20 deployed on the ground in a chosen direction by means of the thruster 30.

Finally, accompanying FIG. 1D is a diagram showing an explosion step implemented using an explosive substance contained in the tube 20.

Documents FR-A-2 214 099 and EP-A-0 305 160 describe mine clearance structures in the form of a carpet of explosives supported by inflatable structures. In practice, it turns out that such carpets of explosives are often difficult to deploy and to use. The teaching of documents FR-A-2 214 099 and EP-A-0 305 160 is nevertheless not transposable to a device that comprises only a single linear assembly of explosives.

An object of the present invention is to improve known systems.

SUMMARY OF THE INVENTION

According to the present invention, this object is achieved by means of a system of the above-specified type comprising:

at least one flexible elongate pyrotechnical-function element; and means suitable for deploying said elongate element in a chosen direction;

wherein the system further comprises a support structure comprising an inflatable flexible container which receives the elongate element and which is provided with internal spacer fins suitable for supporting the elongate element, for being deployed simultaneously therewith, and for supporting the pyrotechnical-function element above the ground.

According to another advantageous feature of the present invention, the inflatable support structure is coextruded with a covering for the elongate pyrotechnical-function element.

As will be understood on reading the following detailed description, the structure of the present invention makes it possible, without disturbing deployment of the device, to improve the effectiveness of known devices by preventing them from being masked by natural or artificial obstacles placed on the ground.

BRIEF DESCRIPTION OF THE DRAWINGS

Embodiments of the invention are described by way of example with reference to the accompanying drawings, in which.

DETAILED DESCRIPTION

Figure 1A:
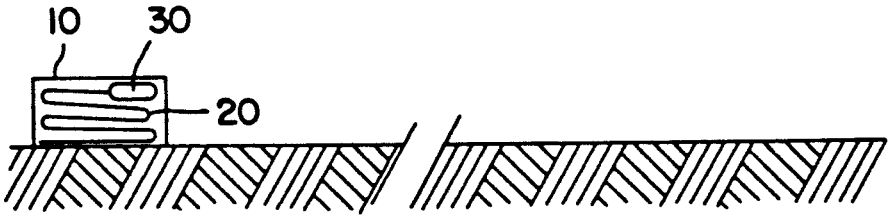
FIG. 1A PRIOR ART
FIGS. 1A, 1B, 1C, and 1D as described above, represent the state of the art.
Figure 1B:
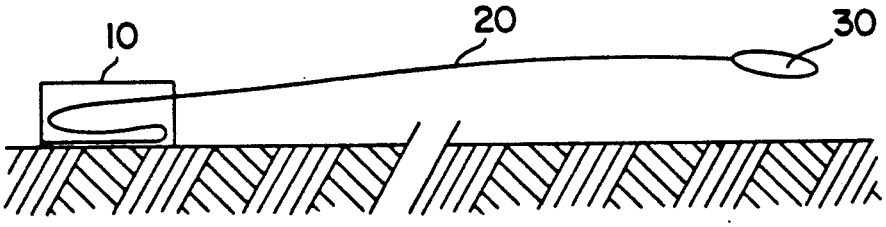
FIG. 1B PRIOR ART
Figure 1C:
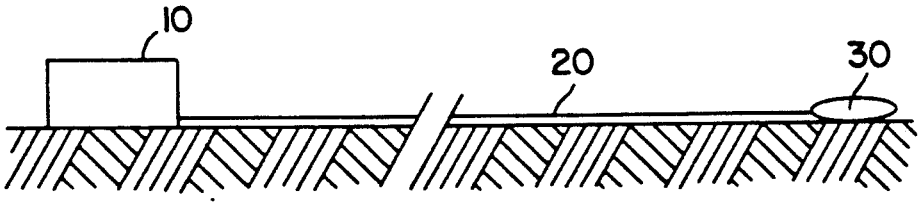
FIG. 1C PRIOR ART
Figure 1D:
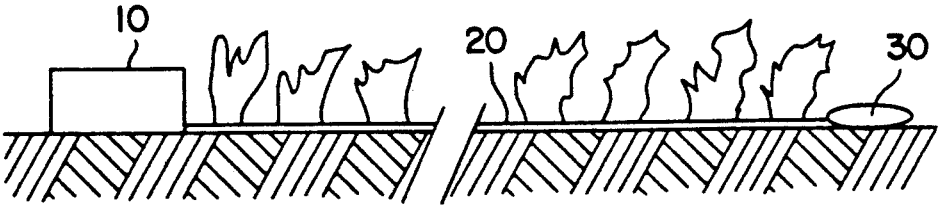
FIG. 1D PRIOR ART
Figure 2:
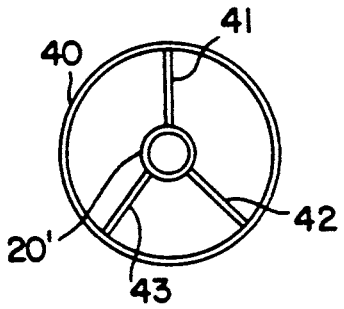
FIGS. 2, 3, and 4 are cross-section views through elongate pyrotechnical-function elements in accordance with three respective different embodiments of the present invention.

FIG. 2 is a diagrammatic section through an elongate pyrotechnical-function element in accordance with a first embodiment of the present invention.

In this first embodiment, the elongate pyrotechnical-function element 20′ is placed in a support structure 40 constituted by an inflatable pipe or container. This container is provided with internal spacer-fins 41, 42, and 43 suitable for supporting the element 20′ such that after being deployed on the ground, the element 20′ is supported at a distance above the ground.

In the particular embodiment shown in FIG. 2, the inflatable pipe 40 has a right cross-section that is circular and it is provided with three spacer-fins 41, 42, and 43 that extend generally radially relative to the axis of the pipe 40 and that are uniformly spaced apart around said axis to support the element 20′ in the center of the support structure 40.

Naturally, the invention is not limited to this particular embodiment.

The pipe 40 may have a section other than that shown in FIG. 2.

In addition, the number of spacer-fins 41, 42, and 43 supporting the pyrotechnical-function element 20′ may be other than the disposition shown in FIG. 2.

Nevertheless, it should be observed that it is preferable for the fins 41, 42, and 43 to be adapted to support the elongate element 20′ substantially in the center of the support structure 40 so as to guarantee that the element 20′ is disposed at a distance from the ground regardless of the orientation of the support structure 40 after it has been deployed.

In an advantageous construction, the support structure 40, the spacer fins 41, 42, and 43, and a central tube forming a covering for the element 20′ are coextruded in flexible material. This material forming the support structure 40, the spacers, and the element 20′ must be flexible so as to enable it to be stored in a coiled down and flattened state inside a container.

Figure 3:
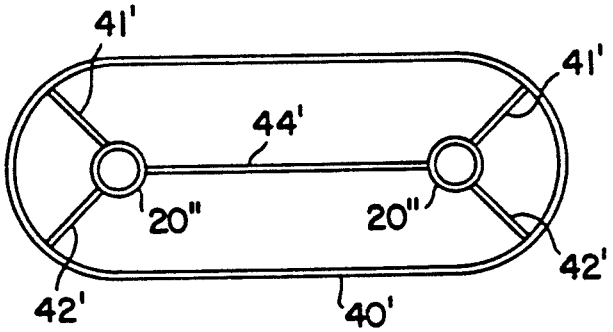

FIG. 3 shows a variant embodiment of the present invention in which two elongate elements 20' are supported in parallel inside a common inflatable container 40' by means of internal spacer fins 41', 42' and 44'.

Naturally, the disposition, and the number of fins shown in FIG. 3 is given purely by way of non-limiting example.

Here again, it is preferable for the inflatable container 40', the various spacer fins 41', 42' and 44' and the tubes 20' to be made by coextruding a flexible material.

The variant embodiment shown in FIG. 3 may be modified so that the number of tubes 20" inside the common inflatable container is greater than three.

Figure 4:
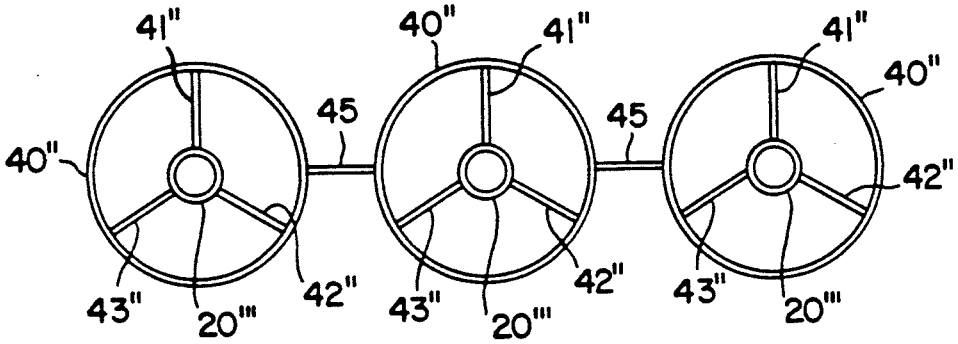

FIG. 4 shows another variant embodiment which comprises three parallel inflatable pipes 40" which are interconnected by external spacer fins 45, and each of which houses a central tube 20" supported by internal spacer fins 41", 42", and 43".

Compared with the variant shown in FIG. 3, that shown in FIG. 4 has the advantage of limiting the volume of the inflatable structure 40" while still covering a passage of greater width than that defined by the first embodiment of FIG. 2.

The fins 45 may be rigid in the lateral direction so as to keep the various pipes 40" spaced apart.

In a variant, the fins 45 may be formed by inflatable structures that are inflated simultaneously with the pipes 40" so as to maintain said spacing.

The inflatable tubes 40" and the associated elongate pyrotechnical-function 20"'are preferably formed as a rectilinear structure.

Figure 5:
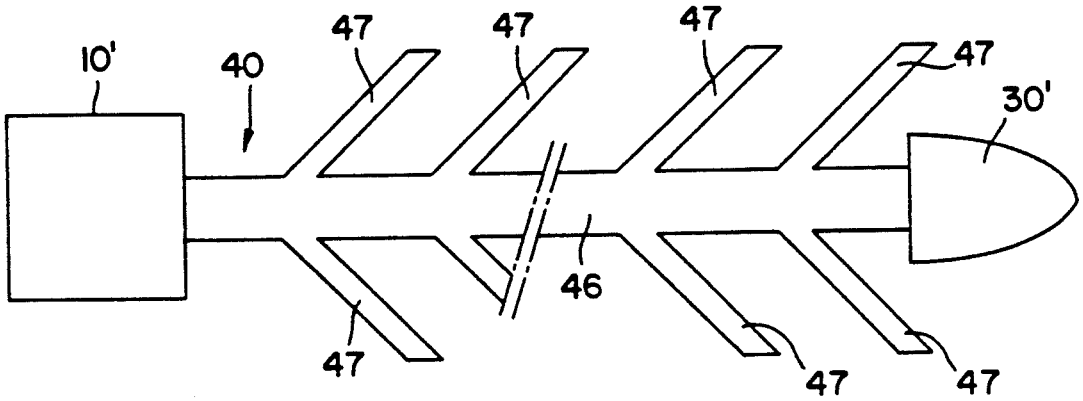
FIG. 5 is a plan view of a system in accordance with the present invention, as deployed on the ground.

Nevertheless, as shown in FIG. 5, it is possible to envisage making said elements in the form of a ramified structure.

FIG. 5 is thus a diagram showing an inflatable pipe 40 comprising a central rectilinear length 46 provided with various ramifications 47.

Under such circumstances, at least one elongate pyrotechnical-function element 20' is placed in the central length 46, and said element 20' is provided with ramifications that extend into respective ones of the various ramifications 47 of the displaceable container 40.

FIG. 5 also shows the container 10' that originally contains the inflatable pipe 40 and the elongate pyrotechnical-function element 20' and the thruster 30' wound down in the flattened position. The container 10' and the thruster 30' are fixed to respective opposite ends of the deployed structure.

Figure 6:
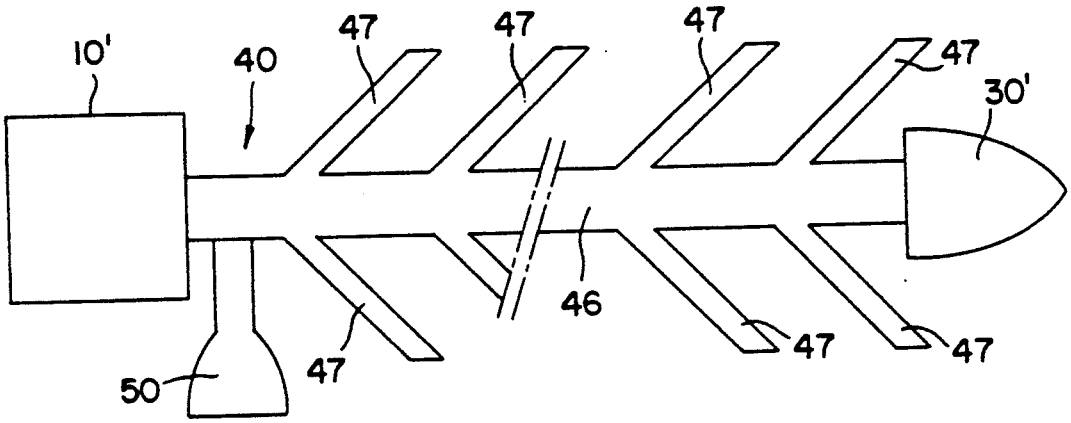
FIG. 6 is a plan view of another embodiment of a system in accordance with the present invention.

The inflatable structure 40 may be inflated by any suitable means, e.g. by one or more cylinders 50 of gas under pressure connected to said structure, as shown in FIG. 6.

The elongate pyrotechnical-function element 20' placed in the inflatable structure 40 may itself be implemented in various different ways.

In a first implementation, said elongate pyrotechnical-function element 20' includes at least one explosive or detonating fuse cord.

In a second embodiment, for use in clearing mines, the elongate pyrotechnical-function element 20' is constituted by a tube designed to receive an explosive liquid, for example an explosive liquid having two components such a nitrate and fuel. Such an explosive liquid can be contained in portable containers connected to the end of the element 20' which is adjacent to the container 10' after said element has been deployed. Under such circumstances, the front end of the tube 20' adjacent to the thruster 30' is closed. The explosive liquid must be triggered remotely. Where applicable, it may be provided with detonating relays distributed along the length of the tube 20'.

In a third embodiment, for incendiary applications, the element 20' is in the for, of a tube suitable for receiving an incendiary liquid. The incendiary liquid may be triggered by a slow burning tracer secured to the thruster 30'.

Under such circumstances, and preferably, the front end of the tube 20' adjacent to the thruster 30 is open.

It may be observed that, in order to maintain combustion, it is possible to connect various containers in succession to the rear end of the tube 20.

Finally, in a fourth embodiment, the elongate element 20' may be in the form of a tube suitable for receiving a pyrophoric composition. Under such circumstances, there is no longer any need to fit the system with a slow burning tracer, since combustion ignites spontaneously in air.

The means used for deploying the elongate element 20' may be constituted by thruster means 30' formed by a rocket connected to the front end of the deployable structure, as described in documents FR-A-2 226 064 and FR-A-2 592 947. Under such circumstances, the structure 40 is inflated after it has been deployed.

In another variant, the deployment means may be constituted by propulsion means formed by at least one cylinder containing gas under pressure and connected to the rear end of the inflatable structure 40 so as to cause it to deploy automatically, together with the pyrotechnical-function element 20' when said structure 40 is inflated.

This latter variant has the advantage of enabling a deployed structure to be implemented that is longer than that which can be envisaged using propulsion means constituted by a rocket.

In another variant, the deployment means may be formed by a mechanical structure designed to deposit the elongate element 20' on the ground.

The inflatable structure 40 is preferably designed to support the elongate pyrotechnical-function element 20' at a distance of at least 20 cm to 50 cm above the ground. In the first embodiment as shown in FIG. 2, the diameter of the inflatable structure 40 thus typically lies in the range 40 cm to 1 m.

The structure of the container 10' that receives the system in the coiled-down state, the means for filling the tube 20', and the thruster 30' are not described in greater detail below. They may all comply with implementations known to the person skilled in the art and described in the above-specified documents, for example.

Naturally, the present invention is not limited to the particular embodiments described above, but extends to any variant coming within the spirit thereof.

We claim:

1. A pyrotechnical system comprising at least one flexible elongate pyrotechnical-function element and means suitable for deploying said elongate pyrotechnical-function element in a chosen direction, wherein the system further comprises a support structure comprising an inflatable flexible container which is inflated using an inflating means including gas, which receives the elongate pyrotechnical-function element and which is provided with internal spacer fins suitable for supporting the elongate pyrotechnical-function element, for being deployed simultaneously therewith, and for supporting the elongate pyrotechnical-function element above the ground.

2. A system according to claim 1, wherein the inflatable container has a right cross-section that is generally circular and that it includes various internal spacer-fins that are uniformly disposed around its axis, for the purpose of supporting the elongate element in a substantially central position.

3. A system according to claim 1, wherein the inflatable container has an oblong right cross-section, wherein it receives a plurality of generally parallel elongate elements, and wherein it includes various internal spacer-fins supporting the elongate elements.

4. A system according to claim 1, comprising a plurality of generally parallel inflatable containers that are connected to one another by external spacer-fins and each of which houses at least one elongate element supported by internal spacer-fins.

5. A system according to claim 1, wherein the inflatable container comprises a generally rectilinear central length coupled to a plurality of ramifications, each receiving at least one ramification of an elongate pyrotechnical-function element.

6. A system according to claim 1, wherein the elongate pyrotechnical-function element is selected from the following group: an explosive fuse cord, a detonating fuse cord, a tube associated with a least one container filled with an explosive liquid, a tube associated with at least one container filled with an incendiary liquid, and a tube associated with at least one container filled with a pyrophoric liquid.

7. A system according to claim 1, wherein the deployment means comprise a rocket.

8. A system according to claim 1, wherein the deployment means comprise a cylinder containing a gas under pressure and suitable for inflating the flexible container forming the support structure.

9. A system according to claim 1, wherein the support structure is designed to support the elongate pyrotechnical-function element above the ground at a distance therefrom lying in the range 20 cm to 50 cm.

10. A system according to claim 1 wherein said elongate pyrotechnical-function element includes one of at least one explosive fuse cord, at least one detonating fuse cord, an incendiary liquid, a pyrophoric composition, and an explosive liquid comprising nitrate and fuel.

11. A system comprising at least one flexible elongate pyrotechnical-function element and means suitable for deploying said elongate pyrotechnical-function element in a chosen direction, wherein the system further comprises a support structure comprising a plurality of generally parallel inflatable containers that are connected to one another by external spacer-fins and that are inflated using an inflating means including gas and each of which houses at least one elongate pyrotechnical-function element supported by internal spacer-fins, so that said elongate pyrotechnical-function element is deployed simultaneously with the support structure, and said support structure supports the elongate pyrotechnical-function element above the ground.

12. A pyrotechnical system according to claim 11, wherein the support structure is designed to support the elongate pyrotechnical-function element above the ground at a distance therefrom lying in the range 20 cm to 50 cm.

13. A pyrotechnical system according to claim 11 wherein said elongate pyrotechnical-function element includes one of at least one explosive fuse cord, at least one detonating fuse cord, an incendiary liquid, a pyrophoric composition, and an explosive liquid comprising nitrate and fuel.

* * * * *